US012006774B2

(12) United States Patent
Russell et al.

(10) Patent No.: US 12,006,774 B2
(45) Date of Patent: Jun. 11, 2024

(54) EARTH BORING TOOLS INCLUDING BRAZED CUTTING ELEMENTS AND RELATED METHODS

(71) Applicant: Baker Hughes Oilfield Operations LLC, Houston, TX (US)

(72) Inventors: Steven Craig Russell, Spring, TX (US); Juan Miguel Bilen, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 17/454,755

(22) Filed: Nov. 12, 2021

(65) Prior Publication Data

US 2023/0151698 A1 May 18, 2023

(51) Int. Cl.
*E21B 10/573* (2006.01)
*E21B 10/633* (2006.01)

(52) U.S. Cl.
CPC ..... *E21B 10/5735* (2013.01); *E21B 10/633* (2013.01)

(58) Field of Classification Search
CPC ..... E21B 10/5735; E21B 10/633
See application file for complete search history.

(56) References Cited

U.S. PATENT DOCUMENTS 7,267,187 B2 9/2007 Kembaiyan
8,061,454 B2 11/2011 Voronin et al.
8,074,869 B2 12/2011 Lyons et al.
8,236,074 B1 * 8/2012 Bertagnolli ..... B24D 99/005 175/428
8,360,176 B2 1/2013 Zhang et al.
9,103,208 B2 8/2015 Macintyre et al.
9,683,410 B2 6/2017 Zhang et al.
9,759,015 B2 9/2017 Miess
10,180,033 B2 1/2019 Bird et al.
10,508,323 B2 12/2019 Russell et al.
2012/0090900 A1 * 4/2012 Prajapati ..... B23K 1/0008 175/428

(Continued)

FOREIGN PATENT DOCUMENTS

GB 2510341 A * 8/2014 ..... E21B 10/54

OTHER PUBLICATIONS

International Search Report for International Application No. PCT/US2022/079688 dated Mar. 29, 2023, 3 pages.

(Continued)

*Primary Examiner* — Cathleen R Hutchins
*Assistant Examiner* — Ronald R Runyan
(74) *Attorney, Agent, or Firm* — TraskBritt

(57) ABSTRACT

An earth boring tool includes a tool body and a cutting element secured to the tool body. The tool body has at least one surface defining a cutting element recess where the cutting element is secured within the cutting element recess by a braze material. The cutting element includes a generally cylindrical substrate having at least one outer surface defining a braze recess. The braze material is disposed at an interface between the cutting element and the cutting element recess, including within the braze recess of the generally cylindrical substrate. The tool body does not include a surface defining a feature on the tool body complementary to the braze recess in the generally cylindrical substrate.

16 Claims, 13 Drawing Sheets

(56) References Cited

U.S. PATENT DOCUMENTS

| | | | | |
|---|---|---|---|---|
| 2013/0199693 | A1* | 8/2013 | Tank | B05B 1/00 175/371 |
| 2014/0007519 | A1* | 1/2014 | Van Staden | E21B 10/5735 51/309 |
| 2014/0373458 | A1* | 12/2014 | Miess | E21B 10/5673 51/309 |
| 2016/0201399 | A1 | 7/2016 | Bird et al. | |
| 2016/0256947 | A1* | 9/2016 | Arfele | E21B 10/633 |
| 2020/0256133 | A1* | 8/2020 | Slotnaes | F16C 33/043 |

OTHER PUBLICATIONS

International Written Opinion for International Application No. PCT/US2022/079688 dated Mar. 29, 2023, 5 pages.

* cited by examiner

EARTH BORING TOOLS INCLUDING BRAZED CUTTING ELEMENTS AND RELATED METHODS

BACKGROUND

Polycrystalline diamond compact ("PDC") cutters have been used in a variety of industrial applications, including downhole drill bits for use in forming boreholes in subterranean formations, such as wellbores. PDC cutters are cutting elements that include cutting faces of a polycrystalline diamond material which is then bonded to a substrate.

Cutting elements are typically mounted on a drill bit body by brazing. The drill bit body is formed with recesses, which are often referred to in the art as "cutter pockets," for receiving a substantial portion of the cutting element in a manner which presents the PDC layer at an appropriate location and orientation for cutting in accordance with the drill bit design. A surface of the volume of polycrystalline diamond material defines a cutting face and/or cutting edge of the cutter. In such cases, a brazing compound is applied to the surface of a substrate of the PDC cutting element to which the PDC layer is bonded and/or in the recess in the bit body in which the cutting element is to be bonded. The cutting elements are installed in their respective recesses in the bit body and heat is applied to each cutting element to raise the temperature to a point that is high enough to melt the brazing compound, after which the brazing compound is allowed to cool and solidify to bond the cutting elements to the bit body within the cutter pockets.

In downhole operations, drill bits and the cutters attached to them are subjected to extreme forces and heat while the cutting through the subterranean formation. In these extreme conditions, the cutting elements attached to the bit body are sometimes fractured or broken off from the drill bit body, which can result in damage to other downhole equipment, reduction of drilling efficiency, and other adverse consequences for the drilling operation.

BRIEF SUMMARY

In some embodiments, an earth boring tool includes a bit body where at least one surface of the bit body defines a cutting element recess in an outer surface of the bit body. The earth-boring tool may also include a cutting element where the cutting element is secured within the cutting element recess by a braze material at an interface between the bit body and the cutting element. The cutting element may include a generally cylindrical substrate that has at least one outer surface that defines a braze recess as well as a polycrystalline diamond compact included on the generally cylindrical substrate. The braze material is disposed between the cutting element and at least one surface of the bit body defining the cutting element recess, including within the braze recess of the generally cylindrical substrate. The bit body does not include a surface defining a feature on the bit body complementary to the braze recess in the generally cylindrical substrate.

A method of securing a cutting element to an earth-boring tool includes disposing a generally cylindrical cutting element within a cutting element recess defined by at least one surface of a bit body where the generally cylindrical cutting element has at least one outer surface defining a braze recess, disposing a braze material between the generally cylindrical cutting element and at least one surface of the bit body defining the cutting element recess, including within the braze recess in at least one outer surface of the generally cylindrical cutting element, and where the bit body does not include a surface defining feature on the bit body complementary to the braze recess in at least one outer surface of the cutting element.

In other embodiments, a method of securing a cutting element to an earth-boring tool includes removing material from at least one outer surface of the cutting element to define a braze recess where removing material includes using conventional machining techniques. The cutting element includes a substrate where at least one outer surface of the substrate defines a braze recess. The braze recess may be defined in a lateral surface and/or a base surface of the substrate.

In other embodiments, a method of securing a cutting element to an earth-boring tool includes rotating a generally cylindrical cutting element relative to a bit body while the generally cylindrical cutting element is disposed within a cutting element recess and a braze material is disposed between the generally cylindrical cutting element and at least one surface of the cutting element recess.

BRIEF DESCRIPTION OF THE SEVERAL VIEWS OF THE DRAWINGS

While the specification concludes with claims particularly pointing out and distinctly claiming what are regarded as embodiments of the present disclosure, various features and advantages of embodiments of the disclosure may be more readily ascertained from the following description of the example embodiments of the disclosure when reading in conjunction with the accompanying drawings, in which:

DETAILED DESCRIPTION

Figure 1:
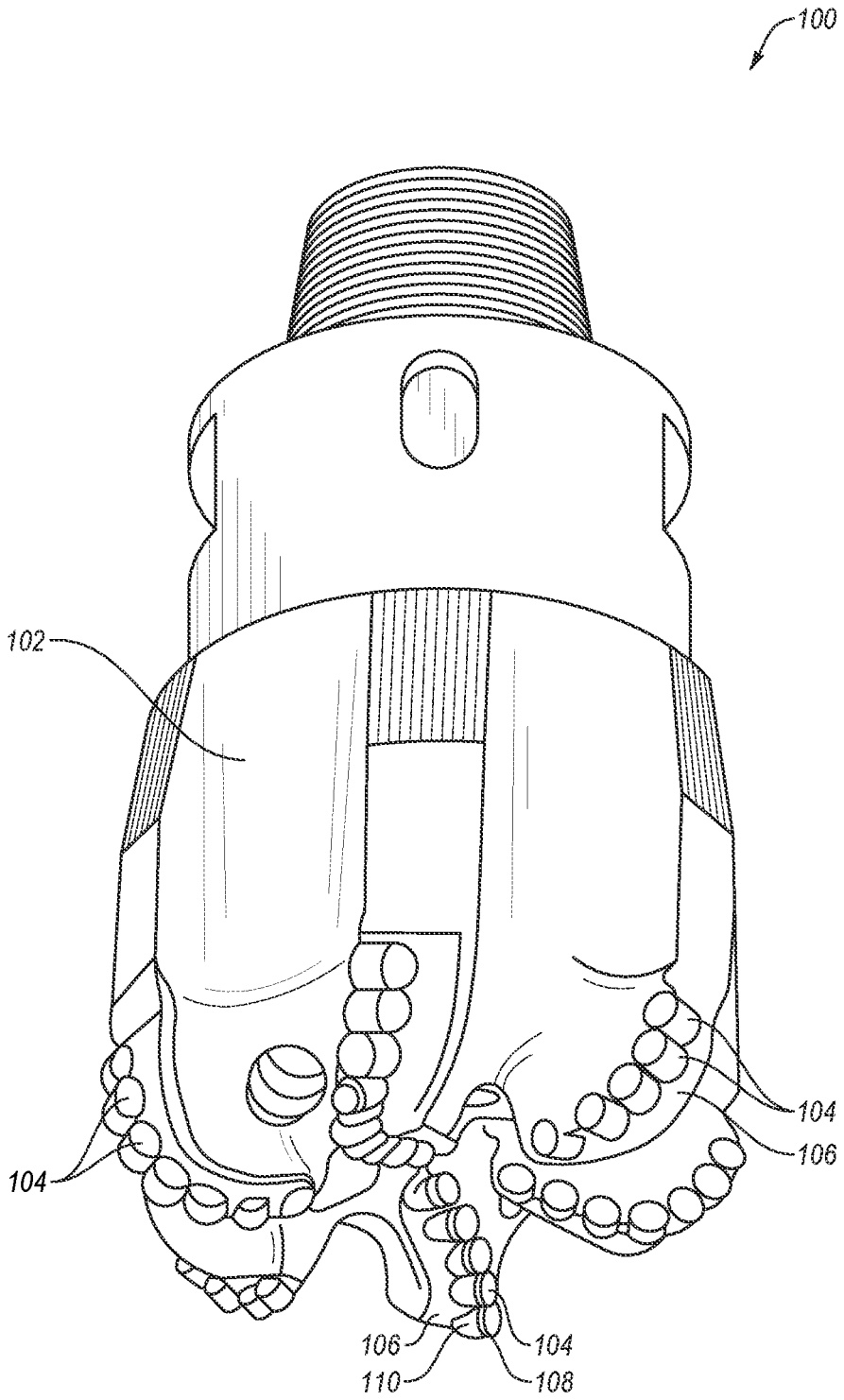
FIG. 1 illustrates an earth-boring rotary drill bit comprising cutting elements secured to the bit body by brazing in accordance with embodiments of the present disclosure.

The illustrations presented herein are not actual views of any particular cutting element, insert, or drill bit, but are merely idealized representations employed to describe embodiments of the present disclosure. Additionally, elements common between figures may retain the same numerical designations.

As used herein, the term "hard material" means and includes any material having a Knoop hardness value of about 1,000 Kg/mm$^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes nay material comprising a plurality of grains or crystals of the material that are bonded directly together by intergranular bonds. The crystal structures of the individual grains of polycrystalline hard material may be randomly oriented in space within the polycrystalline hard material.

As used herein, the term "polycrystalline compact" means and includes any structure comprising intergranular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise, a set of elements may include one or more elements.

Any reference to the terms "braze process," "brazing process," or "brazing" means any type of process involving binding two objects together using a metal filler. This process may include, for example, furnace brazing, torch brazing, or any other method of brazing known in the art.

As used herein, the term "generally" in reference to a given parameter, property, or condition means and includes to a degree that one of ordinary skill in the art would understand that the given parameter, property, or condition is met with a small degree of variance, such as, for example, within acceptable manufacturing tolerances. By way of example, depending on the particular parameter, property, or condition that is generally met, the parameter, property, or condition may be at least 90% met, at least 95% met, or even at least 99% met.

PDC cutters of a down-hole drill bit are often secured to a drill bit body through a brazing process. The brazing process bonds objects together using a metal filler, such as aluminum-silicon alloys, silver-base alloys, and copper-zinc alloys. Additionally, a chemical flux may be used in conjunction with the metal filler in order to facilitate a strong braze. Flux can be used in a paste or a powder form and coated either on the joint to be brazed or coated on the metal filler used for brazing. Flux aids the brazing process by absorbing oxides that otherwise form on the surfaces of the joint when the metal filler is melted and applied thereon. Oxides prevent the metal filler from wetting and adhering to the surfaces of the joint. However, too much flux can also inhibit the wettability of the metal filler and left over flux residue may additionally act as a corrosive material that may lead to damage to the surface it is applied and, as a result, may lead to a weakening of the braze joint. Because of this, excess flux may need to be evacuated during the brazing process in order to ensure a strong braze.

Polycrystalline hard material itself is difficult to braze because the material has poor wettability as well as other factors. Because of this, polycrystalline hard material is conventionally attached to a substrate made from a material, such as tungsten carbide, more suitable for brazing due to, for instance, greater wettability. For example, a flux may be applied to the surfaces of a recess on the bit body in which the cutting element is received. The cutting elements are installed in their respective recesses in the bit body and heat is applied to each cutting element as well as a metal filler to raise the temperature to a point which is high enough to melt the filler and braze the cutting elements to the bit body using the metal filler. In order to promote wettability, the cutting element may be rotated while in the recess to allow the metal filler to fully cover the cutting element substrate as well as the surfaces of the recess. However, because of the typically smooth cylindrical shape of the substrate, the substrate may be difficult to grip and may be difficult to spin in the recess making the brazing process more cumbersome and challenging.

Moreover, because of the forces applied to the cutting element during drilling, in combination with the severe heat and pressure that each cutting element of a drill bit undergoes within the wellbore, the bond formed by brazing the cutting element to the drill bit may fail, leading to cutting elements being forcibly removed from their respective recesses which can result in damage to other downhole equipment, reduction of drilling efficiency, and other adverse consequences for the drilling operation.

FIG. 1 illustrates earth-boring tool 100 in the form of a fixed cutter rotary drill bit. The earth-boring tool 100 includes a bit body 102. One or more cutting elements 104 as described herein may be mounted on the bit body 102 of the earth-boring tool 100, such as on blades 106. The cutting elements 104 may optionally be secured within a cutting element recess formed in the outer surface of the bit body 102 where at least one surface of the bit body defines the cutting element recess in the outer surface of the bit body. Other types of earth-boring tools, such as roller cone bits, percussion bits, hybrid bits, reamers, etc., also may include cutting elements 104 as described herein.

The cutting elements 104 may include a polycrystalline hard material 108. Typically, the polycrystalline hard material 108 may be or include polycrystalline diamond, but may include other hard materials instead of or in addition to polycrystalline diamond. For example, the polycrystalline hard material 108 may be or include cubic boron nitride. Optionally, cutting elements 104 may also include substrates 110 to which the polycrystalline hard material 108 is bonded, or on which the polycrystalline hard material 108 is formed. For example, a substrate 110 may include a generally cylindrical body of cobalt-cemented tungsten carbide material, although substrates of different geometries and compositions may also be employed. The polycrystalline hard material 108 may be in the form of a table (i.e., a layer) of polycrystalline hard material 108 on the substrate 110, as shown in FIG. 1. The polycrystalline hard material 108 may be provided on (e.g., formed on or secured to) a surface of the substrate 110. The cutting elements 104 may be referred to as "polycrystalline compacts," or, if the polycrystalline hard material 108 includes diamond, as "polycrystalline diamond compacts."

The substrate 110 in FIG. 1 may include at least one outer surface that defines a braze recess and which may be secured to the bit body 102 using a braze material disposed between the cutting element and at least one surface of the bit body defining the cutting element recess, including within the braze recess of the substrate 110. Though earth-boring tool 100 is shown having a cutting element 104 with substrate 110, any cutting element or substrate described with respect to the other figures may be used.

In accordance with the present disclosure, cutting elements are described that include a substrate and braze recess located in at least one surface of the substrate. In at least one aspect of the present disclosure, the braze recess allows a greater surface area of the substrate to interface with a braze material order to facilitate improved mechanical retention of the cutting element to the earth-boring tool without necessitating complicated formation of complementary mating surfaces on both the bit body and the cutting element. Moreover, having a braze recess on the cutting element with no complementary features on the earth-boring tool may allow for the cutting element to optionally be rotated during the brazing process and also optionally allowing rotating or removing the cutting element without obstruction after reheating the braze material for maintenance or replacement purposes.

Figure 2B:
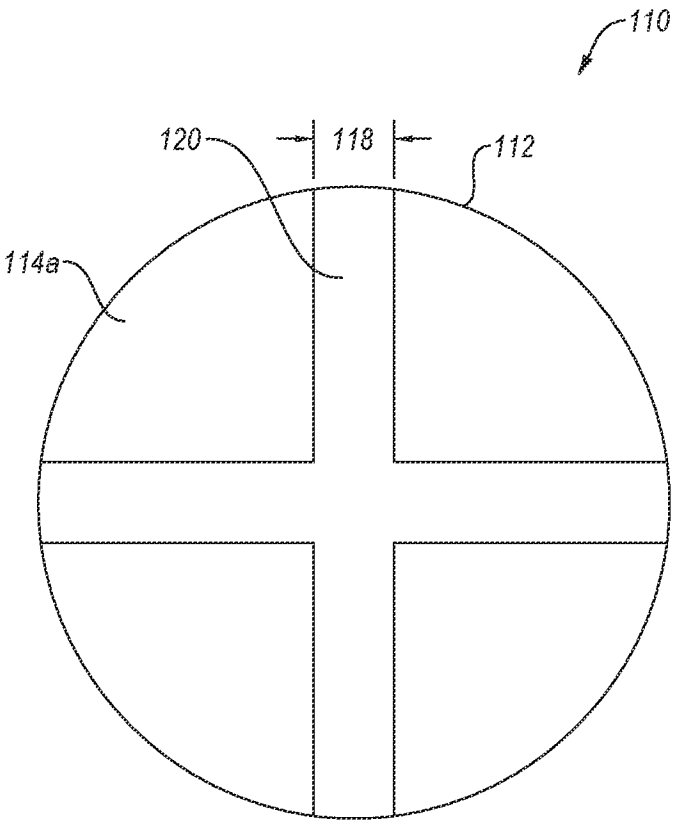
FIG. 2B is a simplified end view of the substrate of FIG. 2A.
Figure 2A:
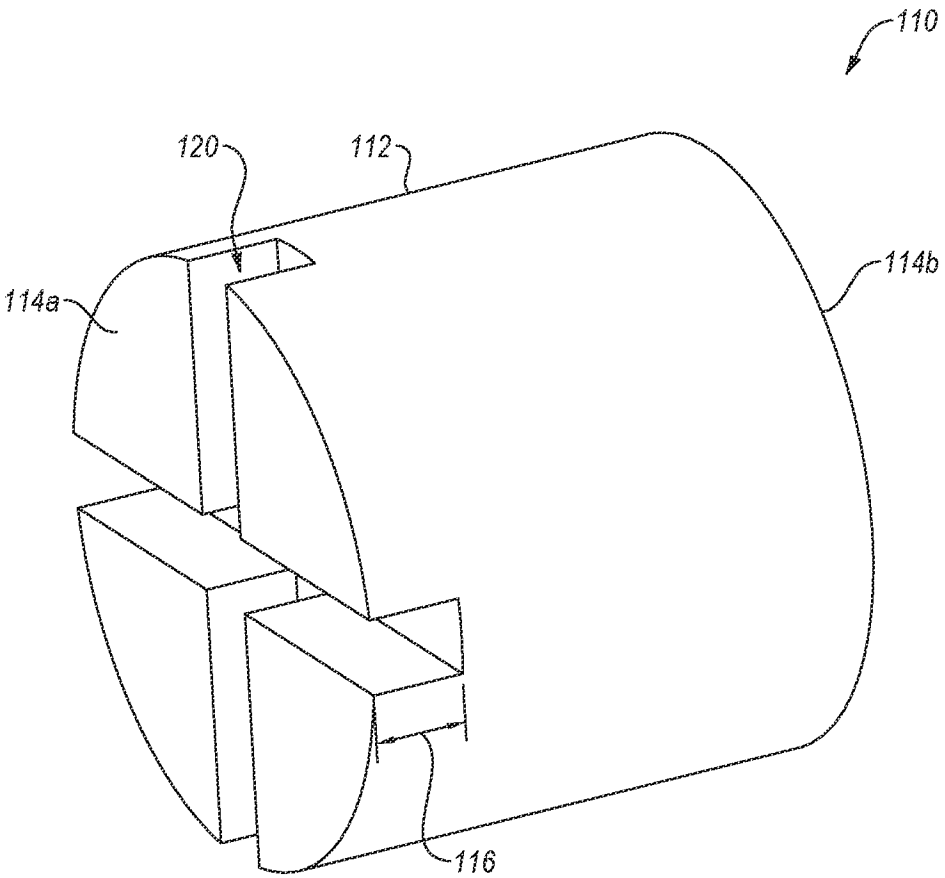
FIG. 2A is a simplified perspective side view of a substrate of a cutting element used in an earth-boring tool.

FIG. 2A illustrates one embodiment of substrate 110 in a simplified perspective side view. The substrate 110 may be generally cylindrical in shape and may include a lateral surface 112 as well as base surfaces 114*a* and 114*b*. In some embodiments, when substrate 110 is disposed within a recess of the bit body 102, base surface 114*a* faces a back surface of a cutting element recess of the bit body 102 and a polycrystalline hard material (e.g., a polycrystalline diamond compact) may be provided on base surface 114*b*. The cutting element may be placed within a cutting element recess in the bit body 102 in such a way so as to allow the polycrystalline hard material to face outward from the bit body 102.

Substrate 110 may include at least one outer surface defining a braze recess 120. For example, as shown in FIG. 2A, braze recess 120 may be defined in base surface 114*a*. In other embodiments, braze recess 120 may be defined in other surfaces of substrate 110 as shown at least in the example embodiments discussed below. Substrate 110 may be secured to a bit body 102 by placing substrate 110 in a recess of bit body 102 and then brazing the substrate 110 to bit body 102. Brazing a cutting element to a bit body may be accomplished by disposing a cutting element 104, including substrate 110, inside of a cutting element recess of bit body 102 and providing a liquefied braze material between the cutting element and at least one surface of the bit body defining a cutting element recess. The braze recess 120 may allow the liquefied braze material to fill the braze recess 120 as the braze material is disposed between the cutting element and the cutting element recess of the bit body 102. The geometry created by the braze recess 120 may allow for a greater surface area of the substrate 110 to come into contact with the braze material as it is secured within the cutting element recess of bit body 102 than conventional substrate geometries. By allowing the greater surface area of substrate 110 including braze recess 120 to interface with the braze material, the mechanical retention of the braze joint between the substrate 110 and the cutting element recess of bit body 102 may be increased. Furthermore, the braze recess 120 may allow for greater flux evacuation than conventional substrate constructions because the braze recess 120 may provide a path for flux to evacuate after the braze material and the flux have been heated to a liquid state and disposed between the cutting element recess of the bit body 102 and the substrate 110 of the cutting element 104. Allowing flux to evacuate may prevent an excess of flux from being disposed in the braze joint, which may lead to a stronger braze joint between substrate 110 and the cutting element recess.

Though substrate 110 is depicted as generally cylindrical, other geometries capable of being disposed within a recess of bit body 102 may be employed. Moreover, braze recess 120, or any braze recess disclosed herein, may be defined in any surface of the employed geometry. Furthermore, the braze recess 120 may cover at least a portion of the surface it is defined in up to and including the entirety of the surface. The braze recess 120 may have a generally rectangular profile as shown, for example, in FIG. 2A, or may have other configurations, such as a triangular or rounded (elliptical) profile. Though the braze recess 120 depicted in FIG. 2A shows uniform braze recess profiles, braze recess 120 may combine different profile shapes.

The braze recess 120 may be formed on substrate 110 by removing material from substrate 110. The removal of material may be accomplished using conventional machining methods including lathing, broaching, milling, boring, drilling, etc. Additionally, braze recess 120 may be formed as a result of the process of forming the substrate. For example, braze recess 120 may be formed by being predefined by a mold where material is disposed within the mold and then hardened to form the substrate 110, thus forming the braze recess 120 in at least one outer surface of the substrate 110 simultaneously with the substrate 110. In another example, the substrate 110 may be formed through a sintering process using a mold with a predefined braze recess 120. In yet another example, the braze recess 120 may be formed initially though additive manufacturing where the substrate 110 is additively manufactured with the braze recess 120 already defined in at least one surface of substrate 110.

With continued reference to FIG. 2A, Substrate 110 may have a braze recess 120 in the form of multiple grooves that are arranged in various ways on the surfaces of the substrate 110. For example, as shown in FIG. 2A, the substrate 110 may have a braze recess 120 in the form of two grooves extending orthogonally in relation to each other creating a cross pattern on the base surface 114*a*. In other embodiments, the braze recess 120 on base surface 114*a* may be in the form of one or a plurality of grooves where the one or more grooves may be irregular in shape and, in the case of having a plurality of grooves, each groove may be at any angle in relation to the other grooves. In some embodiments, braze recess 120 may be in the form of a plurality of grooves extending across base surface 114*a*. For example, in some embodiments, the plurality of grooves may extend generally parallel to each other across base surface 114*a*. As another example, in some embodiments the plurality of grooves may be in the form of two sets of grooves, the first set of grooves extending generally parallel to each other across base surface 114*a* and the second set of grooves extending generally parallel to each other across base surface 114*a* at an angle from about 15 to about 90 degrees relative to the first set of grooves, thus defining a plurality of crossing patterns in base surface 114*a*. In other embodiments, the braze recess 120 defined in the base surface 114*a* of substrate 110 may comprise one or more concentric circles or spirals.

Still referring to FIG. 2A, in some embodiments, the braze recess 120 may extend to a depth 116 into substrate 110 from a surface thereof, where depth 116 is in a range extending from about 0.020 to about 0.120 inches. In other embodiments, the braze recess 120 may extend to a depth 116 into substrate 110 from a surface thereof, where depth 116 may be in a range extending from about 0.002 to about 0.010 inches.

FIG. 2B is a simplified end view of substrate 110 facing base surface 114*a* and displaying a width 118 of the braze recess 120. In some embodiments, the braze recess 120 may extend to a width 118 extending across a surface of substrate 110 in a range extending from 0.020 to about 0.120 inches. In other embodiments, the braze recess 120 may extend to a width 118 extending across a surface of substrate 110 in a range extending from about 0.002 to about 0.010 inches.

Figure 3B:
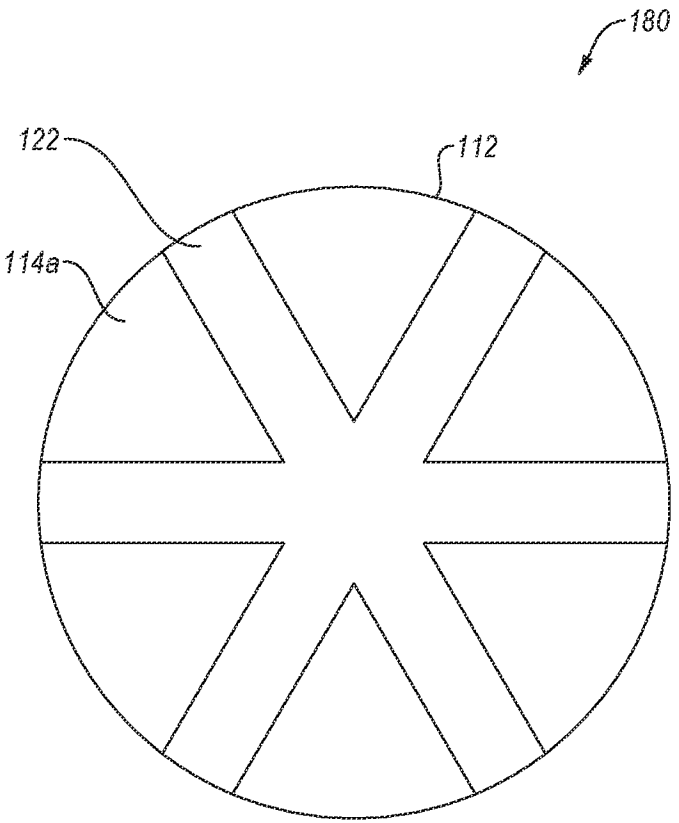
FIG. 3B is a simplified end view of the substrate of FIG. 3A.
Figure 3A:
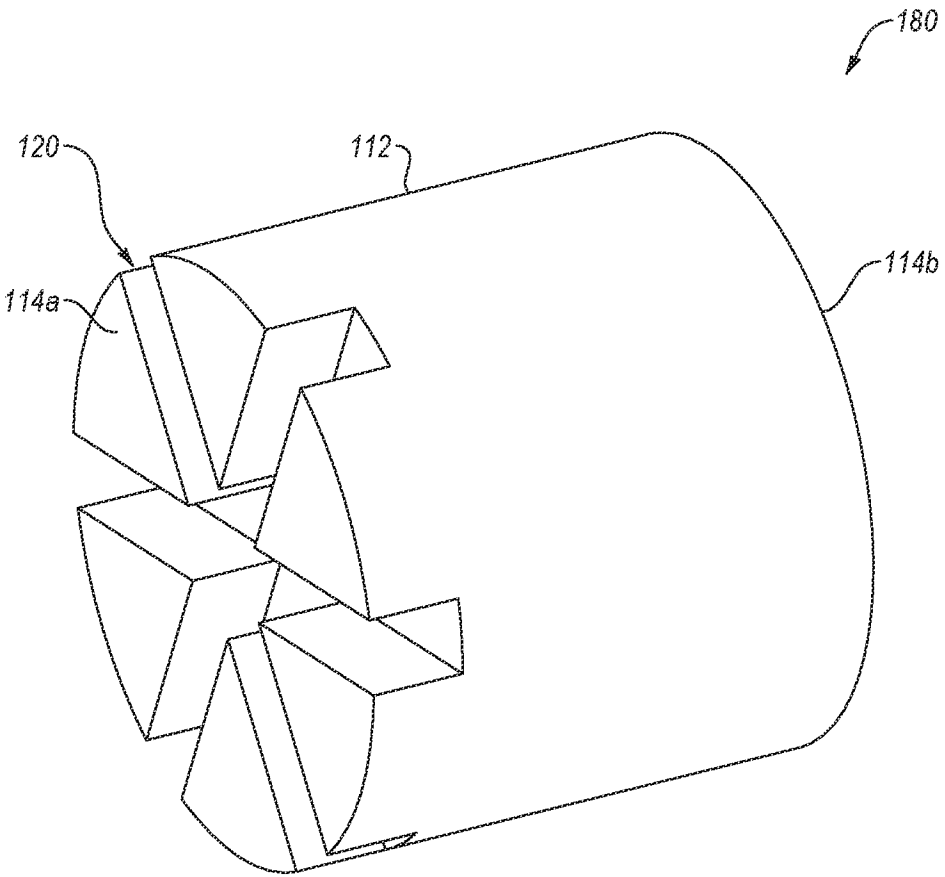
FIG. 3A is a simplified perspective side view of a second substrate of a cutting element used in an earth-boring tool.

FIG. 3A and FIG. 3B illustrate a simplified perspective and end view of an embodiment of substrate 180 having a braze recess 122. The substrate 180 may be identical to substrate 110 but for the configuration of braze recess 122 being in the form of three grooves disposed on a base surface 112*a* and arranged in a crossing pattern where each groove is angled generally equidistant in relation to each of the other grooves.

Figure 4:
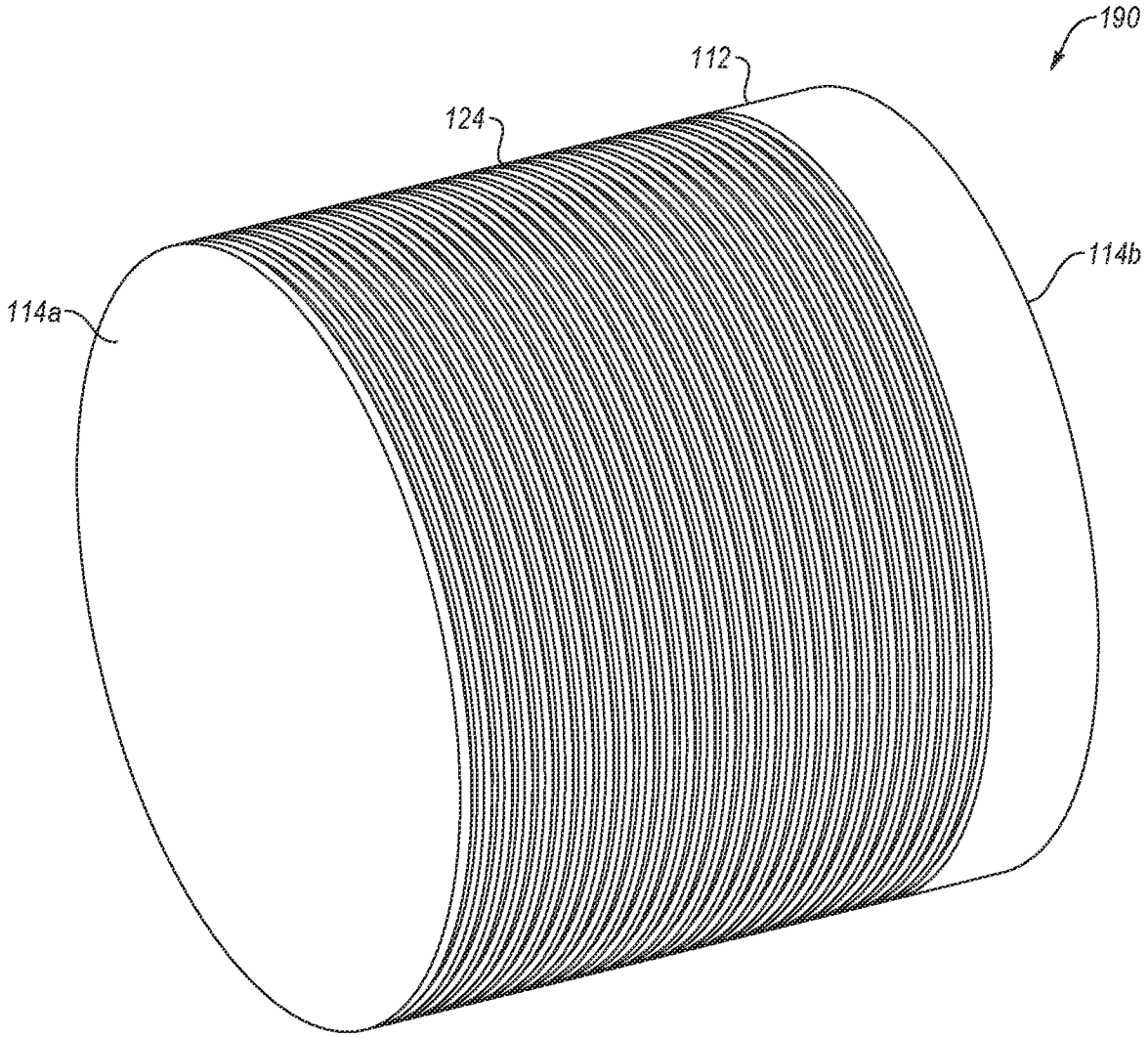
FIG. 4 is a simplified perspective view of a third substrate of a cutting element used in an earth-boring tool.

FIG. 4 is a simplified perspective view of an example embodiment of substrate 190 having a braze recess 124 defined in lateral surface 112 of the substrate 190 where the braze recess 124 is in the form of a groove extending helically around at least a portion of the substrate 190. In the embodiment of FIG. 4, the groove extends helically around an entirety of the substrate 190. In other embodiments the braze recess 124 may be in the form of a groove extending only partially around a portion of the substrate 190. In yet other embodiments, the braze recess 124 may be in the form of one or more grooves extending circumferentially around a portion or an entirety of the substrate. As used herein, the reference to a "braze recess" includes one or more grooves or other recesses which may or may not be contiguous or intersecting.

When brazing a cutting element to an earth-boring tool, once the cutting element has been placed inside the recess with the braze material inside, the substrate of the cutting element may optionally be rotated to help wet the substrate with the braze material and enable a strong braze joint between the bit body and the substrate. Braze recess 124 may allow the braze material to fill the braze recess 124 as the braze material is disposed between the cutting element and at least one surface of the cutting element recess of the bit body 102. When the cutting element is optionally rotated within the cutting element recess with the braze material disposed therein, the helical construction of braze recess 124 may allow for the braze material to more easily fill braze recess 124 as a result of the rotating motion, thereby making it easier to wet the substrate 190 with the braze material. Moreover, as a result of the geometry of braze recess 124 creating more surface area on lateral surface 112, a greater surface area of the substrate 190 may come into contact with the braze material as it is secured within the cutting element recess of bit body 102 compared to conventional substrates that do not include braze recess 124. By allowing the greater surface area of substrate 190 including braze recess 124 to interface with the braze material, the strength of the braze joint between the substrate 190 and the cutting element recess of bit body 102 may be increased. Furthermore, braze recess 124 may allow for greater flux evacuation because braze recess 124 may provide a path for flux to evacuate after the braze material and the flux have been heated to a liquid state and disposed between the cutting element recess of the bit body 102 and substrate 190 of the cutting element. Allowing flux to evacuate may prevent an excess of flux from being disposed in the braze joint, which may lead to a stronger braze joint between substrate 190 and the cutting element recess. Additionally, the braze recess 124 may provide a coarse surface to lateral surface 112 that may make it easier for a person performing the brazing process to grip the substrate 190 in order to turn it during the brazing process to provide a homogeneous wetting of the surfaces of substrate 190 with the braze material. Moreover, braze recess 124 may have a width and a depth that allows a capillary action to occur between the braze recess 124 and the liquefied braze material such that the braze material will flow within the braze recess 124 without the aid of external forces. This capillary action between the braze recess 124 and the braze material may further aid in wetting the surfaces of substrate 190 with braze material and makes it easier to homogeneously wet the surfaces of substrate 190 with the braze material, including while the substrate 190 is disposed within the cutting element recess of the bit body 102. Specifically, as a non-limiting example, the braze recess 124 may extend to a depth into substrate 190 from a surface thereof, where the depth is in a range extending from about 0.002 to about 0.010 inches.

The braze recess 124 may be formed on substrate 190 by removing material from substrate 190. The removal of material may be accomplished using conventional machining methods including lathing, broaching, milling, boring, drilling, etc. Additionally, braze recess 124 may be formed as a result of the process of forming a substrate. For example, braze recess 124 may be formed by being predefined by a mold where material is disposed within the mold and then hardened to form the substrate 190, thus forming the braze recess 124 in at least one outer surface of the substrate 190 simultaneously with the substrate 190. In another example, the braze recess 124 may be formed through a sintering process using a substrate mold with predefined braze recesses. In yet another example, the braze recess 124 may be formed initially through additive manufacturing where the substrate 190 is additively manufactured with the braze recess 124 already defined.

Although the braze recess 124 is shown as being a homogenous pattern defined in lateral surface 112, in some embodiments the substrate 190 may have any number of a variety of braze recess patterns disposed on lateral surface 112, such as, as a non-limiting example, any of the patterns or combination of patterns disclosed in the present disclosure. Moreover, though the braze recess 124 is shown in the form of a single groove extending helically around substrate 190, the braze recess 124 may be in the form of a plurality of grooves where, in one embodiment, the grooves may be disposed on lateral surface 112 as a one or more longitudinally spaced, circular rings around substrate 190 where the rings are generally orthogonal to the longitudinal axis of substrate 190. In FIG. 4, braze recess 124 is shown as being defined in a portion of the lateral surface 112. However, in some embodiments, braze recess 124 may be defined across the entirety of the lateral surface 112.

Figure 5B:
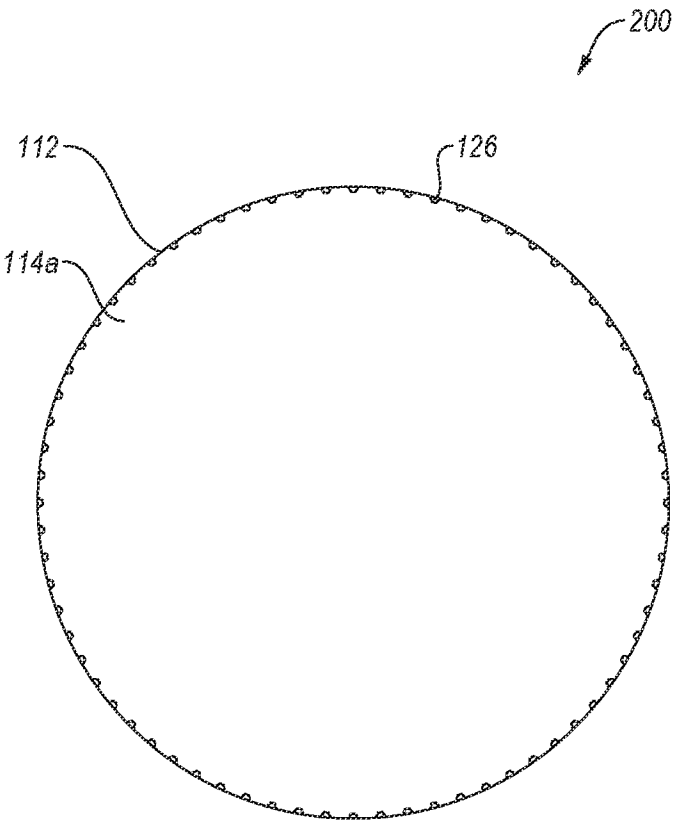
FIG. 5B is a simplified end view of the substrate of FIG. 5A.
Figure 5A:
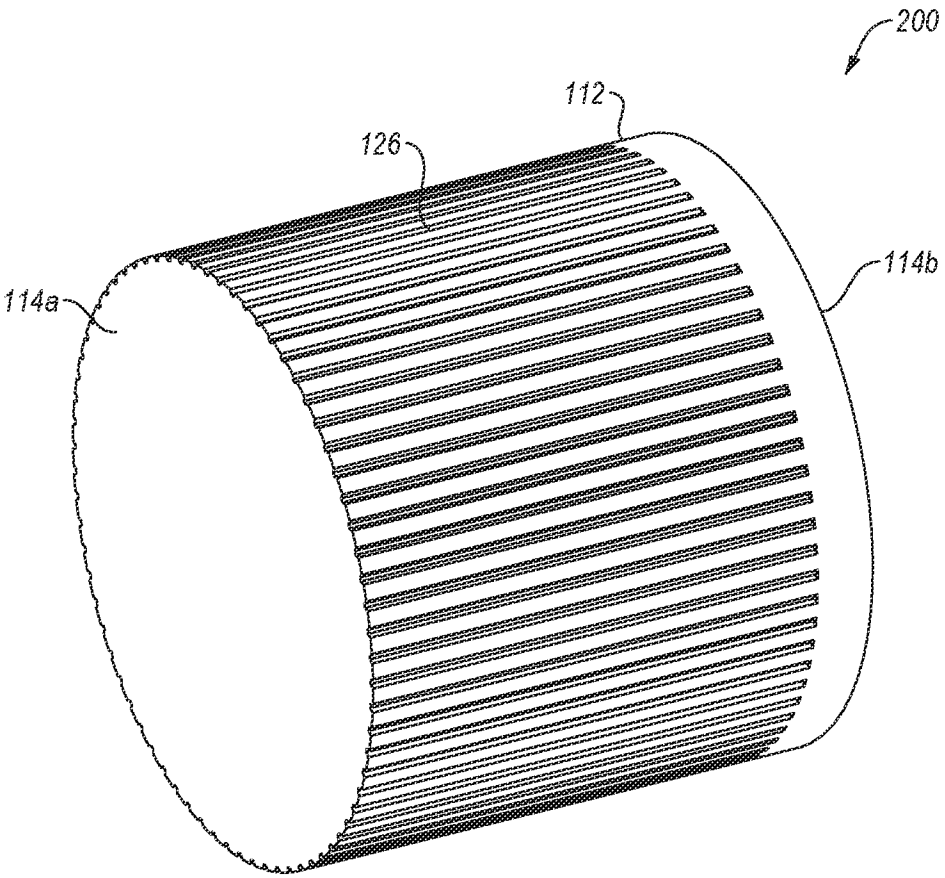
FIG. 5A is a simplified perspective view of a fourth substrate of a cutting element us ed in an earth boring tool.

FIG. 5A and FIG. 5B show a perspective and end view of substrate 200. The substrate 200 may be identical to substrate 190 but for the configuration of braze recess 126 being in the form of one or more longitudinally extending, circumferentially spaced grooves disposed on lateral surface 112 such that the one or more longitudinally extending grooves are generally parallel to the longitudinal axis of substrate 200. Although braze recess 124 is shown in FIG. 5A and FIG. 5B to have the form of a plurality of grooves having a uniform width and depth, in other embodiments, the width and/or depth of each groove may vary.

Figure 6B:
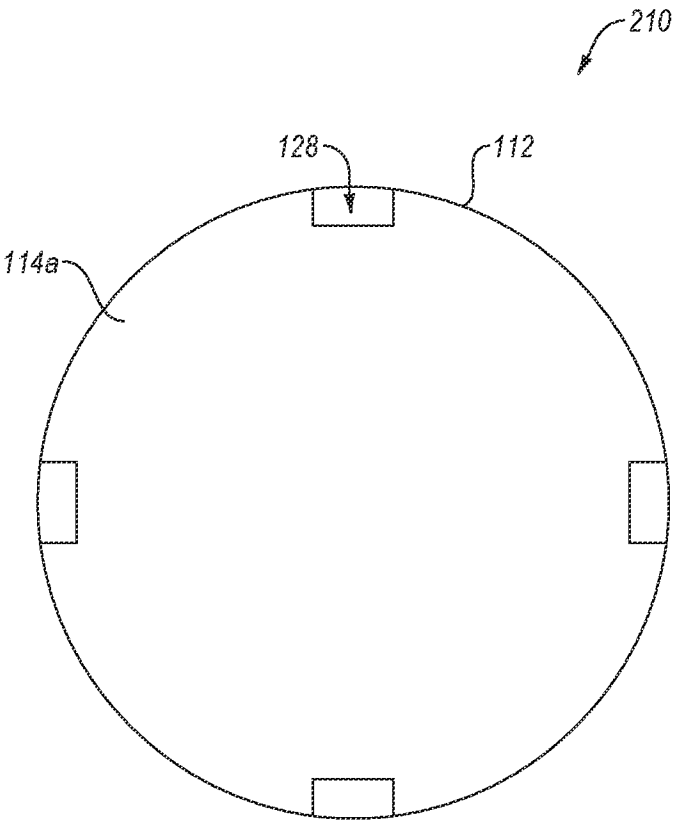
FIG. 6B is a simplified end view of the substrate of FIG. 6A.
Figure 6A:
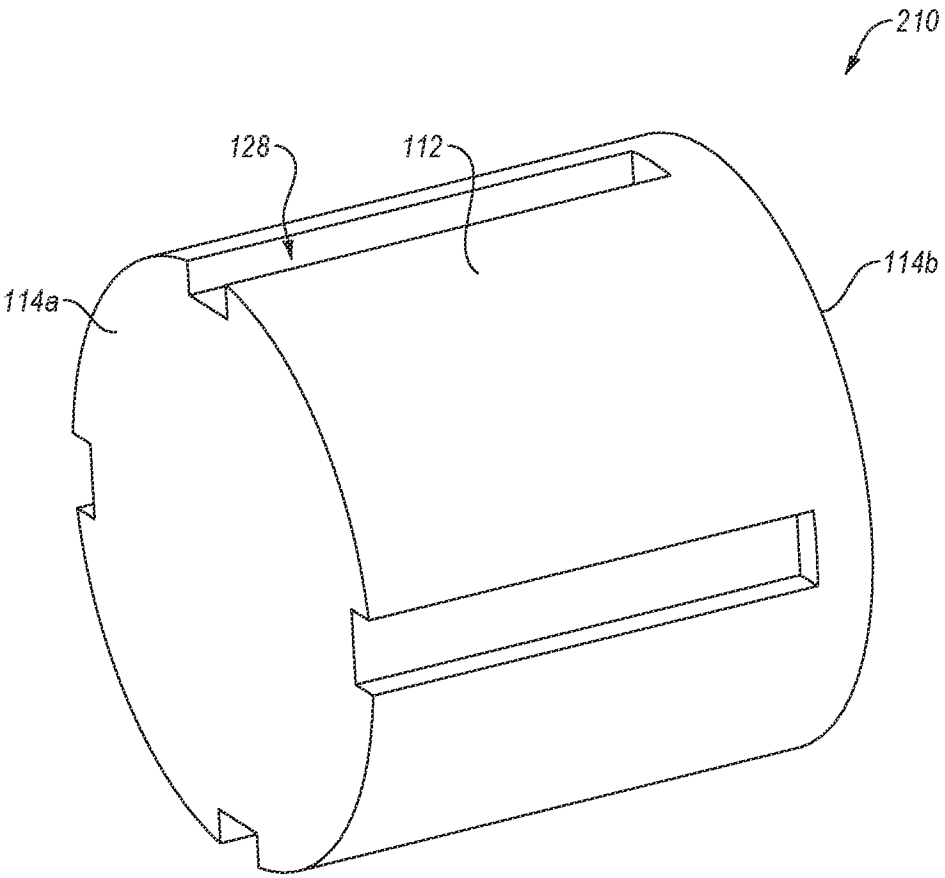
FIG. 6A is a simplified perspective view of a fifth substrate of a cutting element used in an earth boring tool.

FIG. 6A and FIG. 6B show a perspective and end view of substrate 210 having a braze recess 128. Substrate 210 may be identical to substrate 190 but for the configuration of braze recess 128 in the form of four lateral grooves, each generally equidistant from each other as defined on lateral surface 112 and extending generally parallel to a longitudinal axis of substrate 210. In some embodiments, braze recess 128 may extend to a depth into substrate 210 from a surface thereof, where the depth is in a range extending from about 0.020 to about 0.120 inches. Moreover, the braze recess 128 may extend to a width extending across a surface of substrate 210 in a range extending from 0.020 to about 0.120 inches. In yet other embodiments, the braze recess 128 may extend to a depth into substrate 210 from a surface thereof, where depth 116 is in a range extending from about 0.002 to about 0.010 inches. Furthermore, the braze recess 128 may extend to a width 118 extending across a surface of substrate 210 in a range extending from about 0.002 to about 0.010 inches. Though braze recess 128 is shown in FIG. 6A as having four grooves, in additional embodiments, braze recess 128 may be in the form of any number of grooves.

Figure 7B:
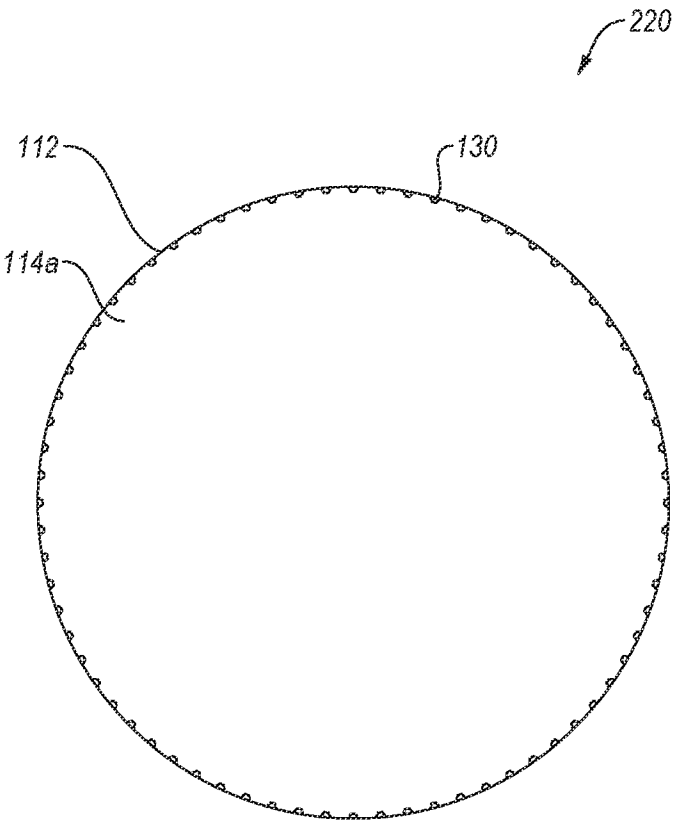
FIG. 7B is a simplified end view of the substrate of FIG. 7A.
Figure 7A:
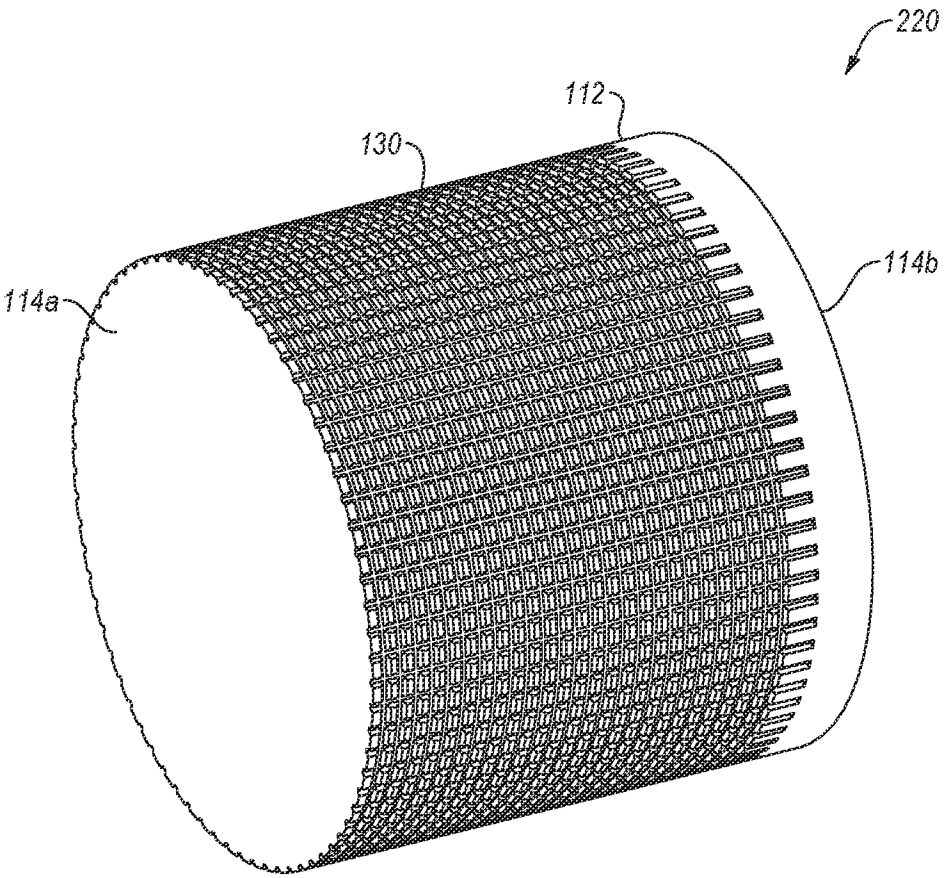
FIG. 7A is a simplified perspective view of a sixth substrate of a cutting element used in an earth boring tool.

FIG. 7A and FIG. 7B show a perspective and end view of substrate 220 having a braze recess 130. Substrate 220 may be identical to substrate 190, but for braze recess 130 being in the form of a first set of grooves and a second set of grooves. In some embodiments, the first set of grooves and the second set of grooves may exhibit any combination of braze recess patterns disclosed herein. In the embodiment shown in FIG. 7A, the first set of grooves extend generally parallel to a longitudinal axis of the substrate 220 and the second set of grooves extend helically around at least a portion of the substrate 220. Moreover, while the first set of grooves and second set of grooves are shown in FIG. 7A to overlap each other, the first set of grooves and the second set of grooves may be arranged such they are generally separate when disposed on lateral surface 112. This separation can occur either laterally or vertically across lateral surface 112.

Figure 8B:
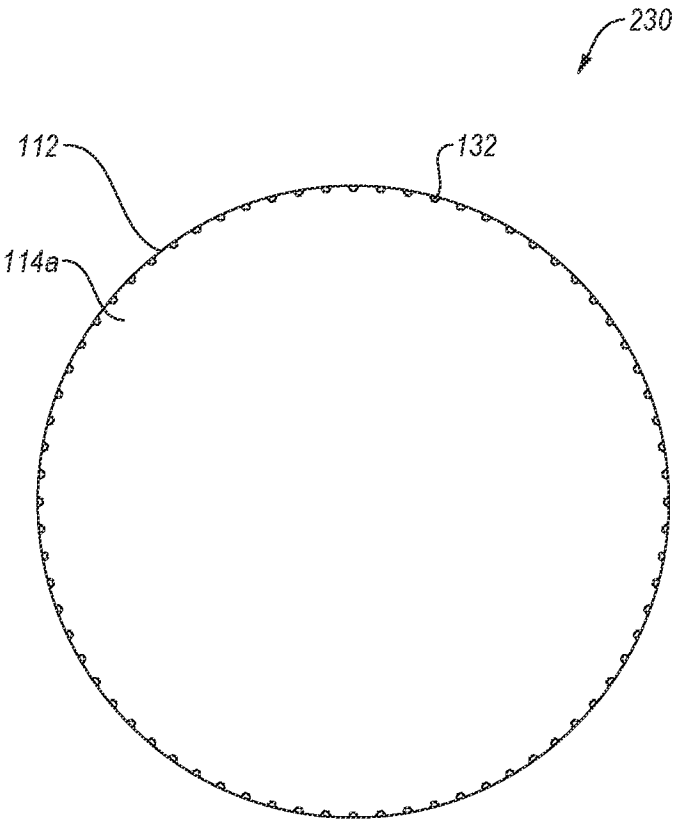
FIG. 8B is a simplified end view of the substrate of FIG. 8A.
Figure 8A:
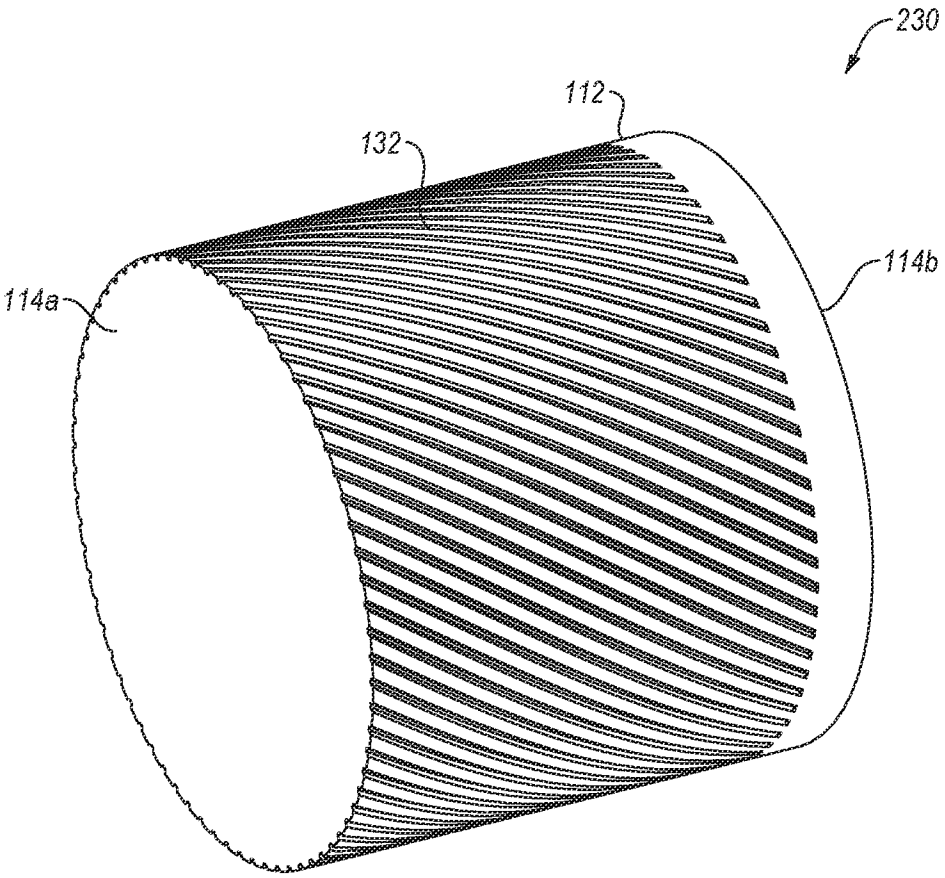
FIG. 8A is a simplified perspective view of a seventh substrate of a cutting element used in an earth boring tool.

FIG. 8A and FIG. 8B show a perspective and end view of substrate 230 having a braze recess 132. Substrate 230 may be identical to substrate 190, but for braze recess 132 being in the form of at least one groove extending helically around at least a portion of substrate 230 at an angle from about 15 to about 75 degrees in relation to a longitudinal axis of substrate 230. In the embodiment shown in FIG. 8, a plurality of grooves extend helically around at least a portion of substrate 230 at a generally 45 degree angle in relation to the longitudinal axis of substrate 230.

Figure 9B:
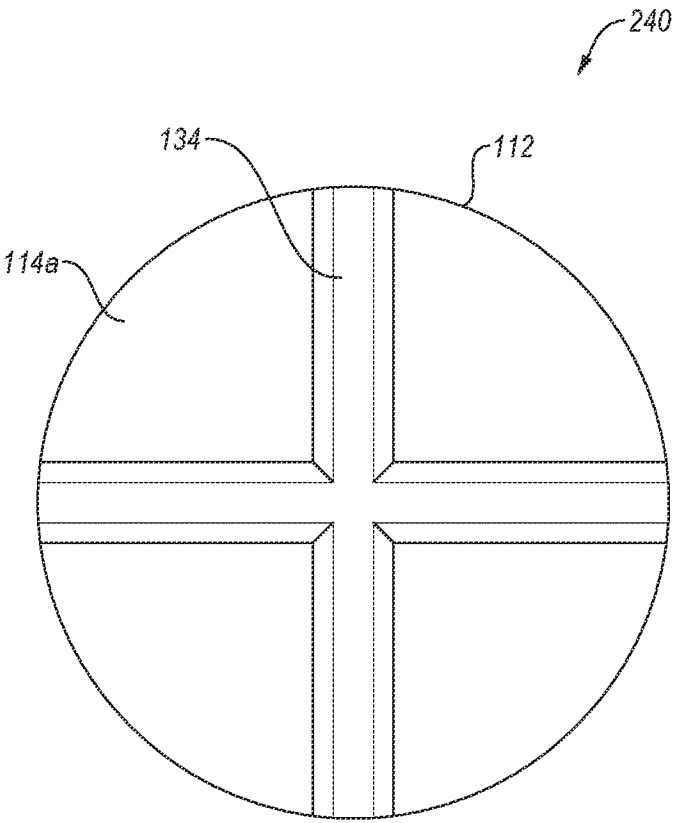
FIG. 9B is a simplified end view of the substrate of FIG. 9A.
Figure 9A:
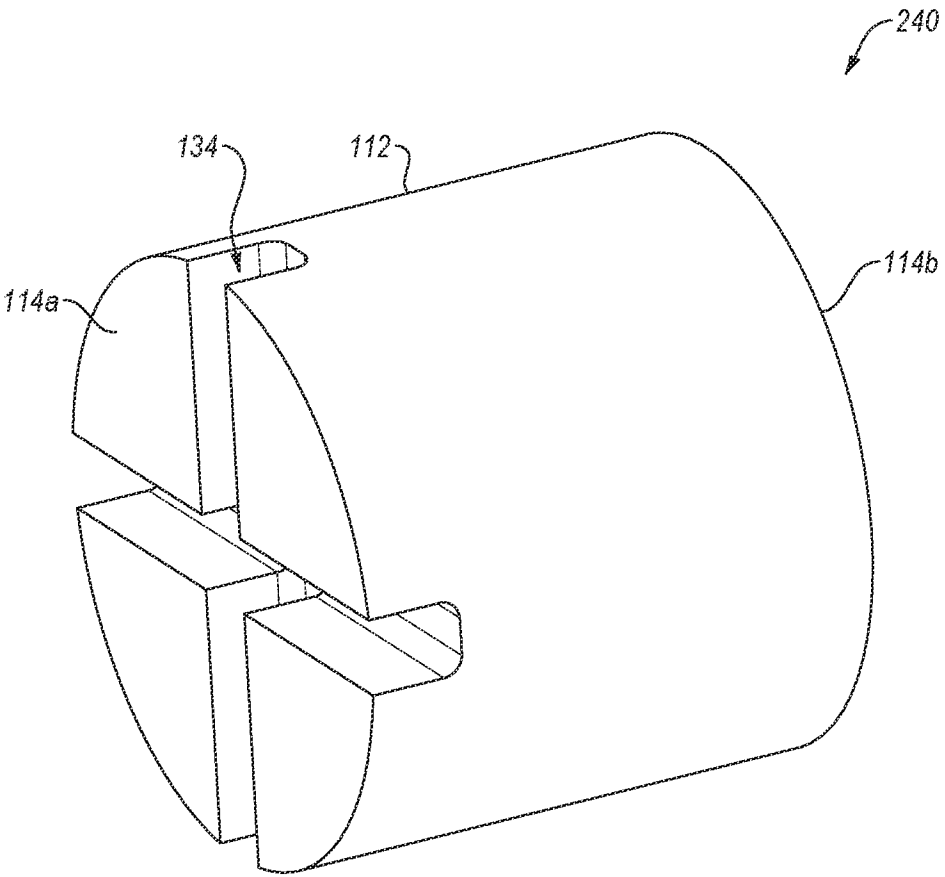
FIG. 9A is a simplified perspective view of an eighth substrate of a cutting element used in an earth boring tool.

FIG. 9A and FIG. 9B show a perspective and end view of an example embodiment of substrate 240 having a braze recess 134. Substrate 240 may be identical to substrate 110 but for having a braze recess 134 in the form of two grooves extending generally orthogonal to each other and defined in base surface 114*a* where the grooves have a generally rounded (elliptical) transverse profile. In some embodiments, braze recess 134, or any braze recess disclosed herein, may be in the form of any number of grooves having a combination of different profile shapes including generally triangular, trapezoidal, or rectangular shapes.

Figure 10:
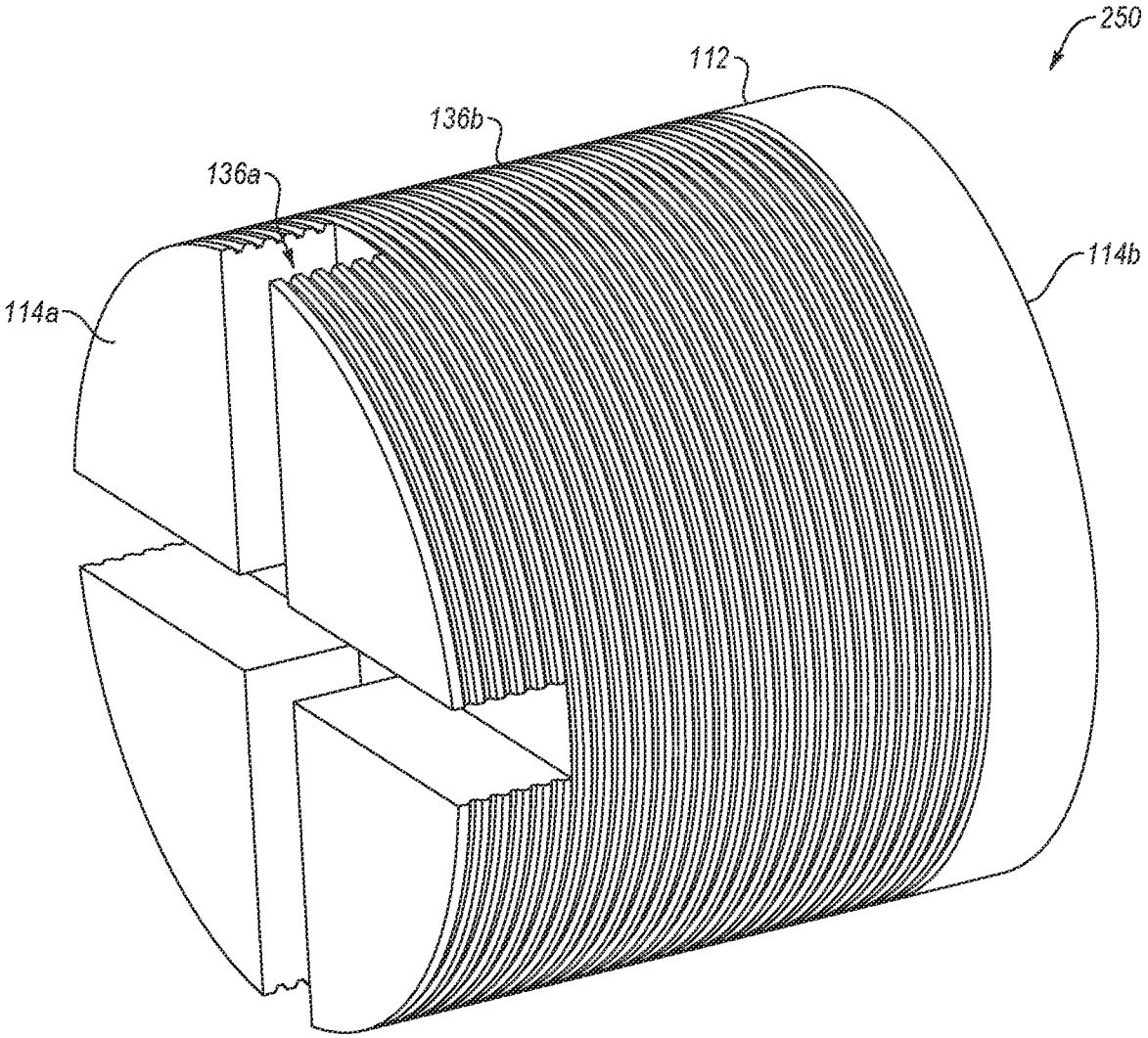
FIG. 10 is a simplified perspective view of a ninth substrate of a cutting element used in an earth boring tool.

FIG. 10 shows a perspective view of an example embodiment of substrate 250 having a braze recess 136*a* and a braze recess 136*b*. Substrate 250 may combine attributes of substrate 110 shown in FIG. 2A and substrate 190 shown in FIG. 4, having all of the related advantages of those embodiments. Substrate 240 may have at least one braze recess defined in a base surface, such as base surface 114*a*, and at least one braze recess defined in lateral surface 112. FIG. 10 shows one example embodiment including braze recess 136*b* defined in lateral surface 112 and in the form of a groove extending helically around at least a portion of substrate 250. Additionally, braze recess 136*a* is shown defined in base surface 114*a* and in the form of two grooves extending orthogonally in relation to each other in a cross pattern. However, in other embodiments any combination of braze recesses disposed on a base surface and a lateral surface are contemplated.

Figure 11:
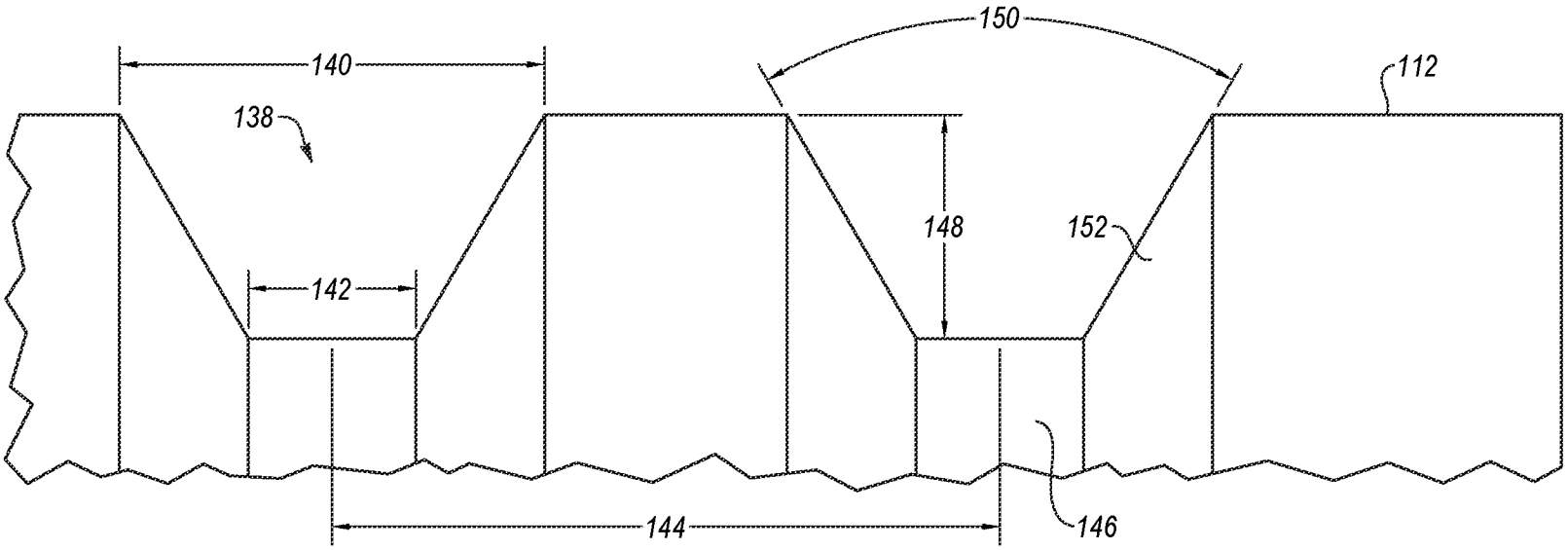
FIG. 11 is a cross section view of the substrate of FIG. 4.

FIG. 11 shows a schematic cross sectional view of a substrate having a braze recess 138 which may correlate to any embodiment discussed herein. As shown, an example braze recess 138 may have a braze recess surface width 140 and a braze recess base width 142 in addition to a braze recess angle 150 that may be defined by the ratio between the braze recess surface width 140 and the braze recess base width 142. Moreover, though the braze recess surface width 140 is depicted as being greater than the braze recess base width 142, other embodiments may have the braze recess surface width 140 be equal to or less than the braze recess base width 142. For example, the braze recess surface width 140 may extend across a surface of the substrate in a range extending from 0.020 to about 0.120 inches and the braze recess base width 142 may be in a range extending from 0.020 to about 0.120 inches. In other embodiments, the braze recess surface width 140 may extend across a surface of the substrate in a range extending from about 0.002 to about 0.010 inches and the braze recess base width may be in a range extending from about 0.002 to about 0.010 inches. Additionally, braze recess 138 may extend to a depth 148 into a substrate from a surface thereof, where the depth 148 is the distance from the plane defined by the lateral surface 112 to the braze recess base surface 146. The depth 148 may be in a range extending from about 0.020 to about 0.120 inches. In other embodiments, the depth 148 may in a range extending from about 0.002 to about 0.010 inches. Furthermore, in some embodiments, braze recess 138 may be in the form of a helical groove that extends at least once around the entire circumference of a substrate and where the lateral distance between the helical groove as it extends at least once around the substrate is defined by the pitch distance 144. In some embodiments, the pitch distance 144 is from about 0.04 to about 0.015 inches. In additional embodiments the pitch distance 144 may be any distance so long as the helical groove extends at least once around the substrate. Forming braze recess 138 in at least one surface of a substrate increases the surface area of the substrate that can interface with a braze material. The amount of surface area of a substrate with braze recess 138 is affected by each of at least the braze recess angle 150, the depth 148, braze recess surface width 140, braze recess base width 142, and the pitch distance 144.

Figure 12:
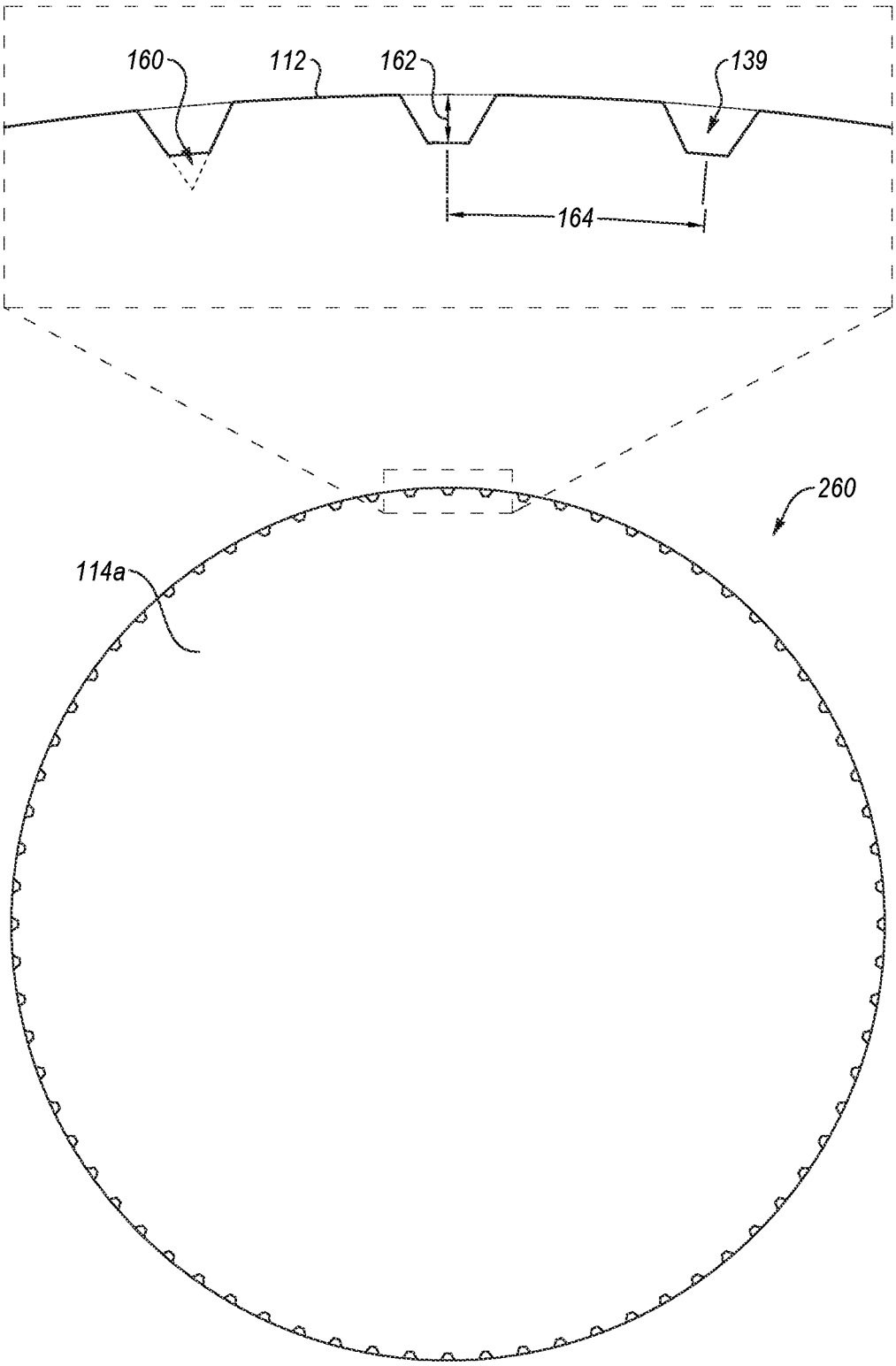
FIG. 12 is a detailed cross sectional end view of FIG. 5A.

FIG. 12 shows a detailed end view illustrating a profile view of braze recess 139, which may correlate with any embodiment herein. Braze recess 139 may be in the form of a groove defining a profile in a base surface of substrate 260 and extending a depth 162 into substrate 260. In some embodiments, braze recess 139 may be in the form of a plurality of lateral grooves where the lateral grooves may be defined in the lateral surface 112 such that the distance (i.e., pitch) between a center of each groove of the plurality of lateral grooves is defined by the disposition angle 164. The disposition angle 164 may in in the range from about 2 to 8 degrees of radial distance between each groove of the plurality of lateral grooves measured around the circumference of a base surface of substrate 260. Though the disposition angle 164 is shown to be uniform across substrate 260, in other embodiments the disposition angle 164 may vary between each lateral groove of the plurality of lateral grooves. Braze recess 139 may also have different profile shapes. For example, braze recess 139 may have a generally trapezoidal profile as shown in FIG. 12, or may have a generally triangular profile 160. In other embodiments, the braze recess 139 may have a generally rounded or elliptical profile.

Figure 13:
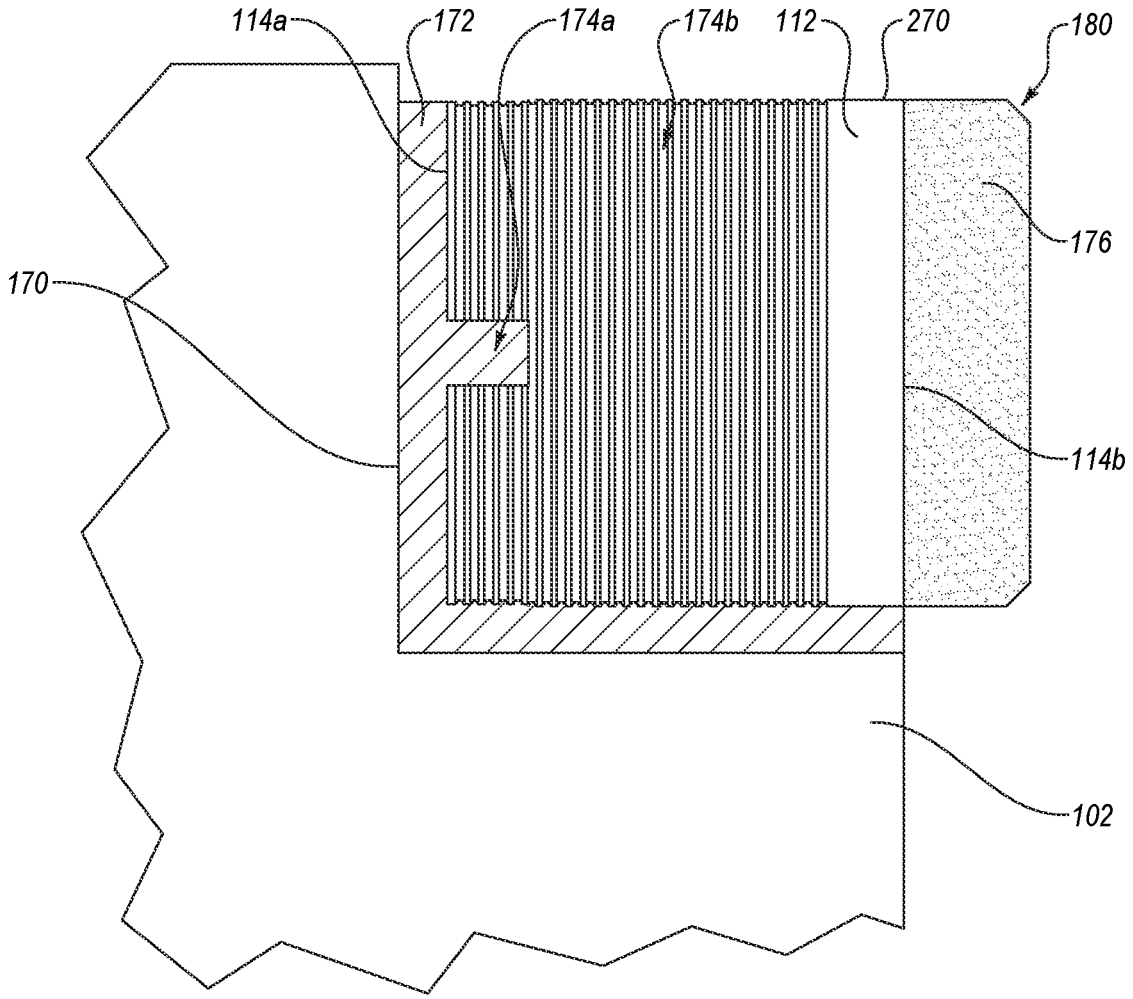
FIG. 13 is a side view of the substrate of FIG. 10 disposed in an earth boring tool.

FIG. 13 shows a simplified side view illustrating how substrate 270 may be disposed in bit body 102. Substrate 270 may be identical to substrate 250 including all related advantages discussed in relation thereto. A cutting element 180 that includes substrate 270 may be disposed within cutting element recess 170 of bit body 102 such that base surface 114*a* faces a back surface of cutting element recess 170 and a polycrystalline diamond compact 176 included on base surface 114*b* faces outward from the bit body 102. Braze material 172 may be disposed in cutting element recess 170 such that the braze material 172 is disposed at an interface between substrate 270 and the bit body 102 and fills the space between the substrate 270 and the cutting element recess 170 including within braze recess 174*a* and/or braze recess 174*b*. In some embodiments, braze recess 174*a* and/or braze recess 174*b* may be of a size that allows for a capillary action to occur with liquefied braze material. Cutting element 180 including substrate 270 may be disposed within the cutting element recess 170 such that part of substrate 270 at least partially rises above the cutting element recess 170 whereas, in other embodiments, substrate 270 may be wholly covered by the cutting element recess 170.

Braze material 172 may be composed of any material able to form a braze joint between cutting element 180 including substrate 270 and the cutting element recess 170. In some embodiments, the braze material may include manganese (MN), aluminum (AL), phosphorus (P), silicon (Si), or zinc (Zn) alloyed with nickel (Ni), copper (Cu) or silver (Ag).

In some embodiments, the bit body 102 does not include a surface, such as the surfaces of cutting element recess 170, defining a feature on the bit body complementary to a braze recess defined in at least one surface of substrate 270. In other embodiments, the bit body 102 may include surfaces, such as the surfaces of cutting element recess 170, that are coarse or rough to increase the wettability of the surfaces while not directly interfacing complementarily with a braze recess defined in at least one surface of substrate 270.

A brazing process where a cutting element may be secured to a downhole earth-boring tool may include disposing a cutting element within a cutting element recess defined by at least one surface of a bit body where at least one outer surface of the cutting element defines a braze recess. In some embodiments the cutting element may be generally cylindrical. In one example of this process, a braze material, including a flux compound, may be heated to a temperature sufficient to allow the braze material to bond the cutting element to a bit body. Typically, this involves heating the braze material to its melting point and then disposing the braze material and the flux compound in the cutting element recess prior to the placing of the cutting element. However, in other example processes the braze material and flux compound may be heated and disposed after the cutting element has been disposed within the cutting element recess. In the case of disposing the braze material before disposing the cutting element within the cutting element recess, once the cutting element has been placed inside the recess with the braze material disposed between the cutting element and at least one surface of the cutting element recess, the substrate of the cutting element may optionally be rotated relative to the bit body to help wet the substrate with the braze material to enable a strong braze joint between the bit body and the substrate. The braze recess defined in at least one surface of the cutting element may allow for a capillary action with the braze material such that liquefied braze material flows within the braze recess without the aid of external forces. This capillary action aids in wetting the surfaces of the cutting element and the cutting element recess with the braze material. Moreover, braze recesses defined in one or more surfaces of the cutting element may allow for greater flux evacuation as a braze recess may provide a path for flux to evacuate after the braze material and the flux have been heated and disposed between the cutting element recess of the bit body and the cutting element.

With regard to the cutting element, a braze recess may be defined in at least one outer surface of the cutting element. For example, a braze recess may be defined in a lateral surface of the cutting element, in a base surface of the cutting element, or both. In some embodiments, the braze recess may be formed by removing material from at least one outer surface of the cutting element. In a non-limiting example, the material may be removed from the cutting element through conventional machining methods including lathing, broaching, milling, boring, drilling, etc. In other embodiments, a braze recess may be formed simultaneously with the substrate of the cutting element. For example, in certain embodiments the braze recess may be defined in a cutting element mold such that, when material is poured into the mold and hardened the resulting cutting element will include a braze recess. In other embodiments a braze recess may be defined when using additive manufacturing to form the cutting element such that the material is additively applied defining a braze recess as part of the initially formed cutting element shape.

While the present disclosure has been described herein with respect to certain illustrated some embodiments, those of ordinary skill in the art will recognize and appreciate that the present invention is not so limited. Rather, many additions, deletions, and modifications to the illustrated and described some embodiments may be made without departing from the scope of the invention as hereinafter claimed along with their legal equivalents. In addition, features from one some embodiment may be combined with features of another some embodiment while still being encompassed within the scope of the invention as contemplated by the inventor.

What is claimed is:

1. An earth-boring tool, comprising:

a bit body, at least one surface of the bit body defining a cutting element recess in an outer surface of the bit body;

a cutting element secured within the cutting element recess by a braze material at an interface between the bit body and the cutting element, the cutting element including:

a generally cylindrical substrate comprising:

a lateral surface defining a first braze recess, at least part of the first braze recess flanked by the lateral surface on each side of the first braze recess; and a base surface different from the lateral surface, the base surface defining a second braze recess, at least part of the second braze recess flanked by the base surface on each side of the second braze recess;

a polycrystalline diamond compact on the generally cylindrical substrate;

wherein the braze material is disposed between the generally cylindrical substrate of the cutting element and the at least one surface of the bit body defining the cutting element recess, including within the first braze recess of the generally cylindrical substrate;

wherein the braze material is in direct contact with a surface of the first braze recess; and wherein the bit body does not include a surface defining a feature on the bit body complementary to the first braze recess in the generally cylindrical substrate.

2. The earth-boring tool of claim 1, wherein the first braze recess is in the form of a groove extending circumferentially or helically around at least a portion of the generally cylindrical substrate.

3. The earth-boring tool of claim 2, wherein the groove extends helically at least once around an entire circumference of the generally cylindrical substrate, and a pitch distance of the groove extending helically around the generally cylindrical substrate is from about 0.04 to about 0.015 inches.

4. The earth-boring tool of claim 2, wherein the groove extends helically around at least a portion of the generally cylindrical substrate at an angle from about 15 to about 75 degrees in relation to a longitudinal axis of the generally cylindrical substrate.

5. The earth-boring tool of claim 1, wherein the first braze recess is in the form of a groove extending generally parallel to a longitudinal axis of the generally cylindrical substrate.

6. The earth-boring tool of claim 1, wherein the first braze recess is in the form of a first set of grooves and a second set of grooves, the first set of grooves extending generally parallel to a longitudinal axis of the generally cylindrical substrate and the second set of grooves extending circumferentially or helically around at least a portion of the generally cylindrical substrate.

7. The earth-boring tool of claim 1, wherein the first braze recess extends to a depth into the generally cylindrical substrate from a surface thereof, the depth being in a range extending from about 0.002 to about 0.010 inches.

8. The earth-boring tool of claim 1, wherein the first braze recess extends to a depth into the generally cylindrical substrate from a surface thereof, the depth being in a range extending from about 0.020 to about 0.120 inches.

9. The earth-boring tool of claim 1, wherein the second braze recess is in the form of two grooves extending orthogonally in relation to each other.

10. The earth-boring tool of claim 1, wherein the first braze recess is in the form of a groove extending circumferentially or helically around at least a portion of the generally cylindrical substrate and the second braze recess is in the form of two grooves extending orthogonally in relation to each other.

11. A method of securing a cutting element to an earth-boring tool, comprising:

disposing a generally cylindrical cutting element within a cutting element recess defined by at least one surface of a bit body, the generally cylindrical cutting element having a lateral surface defining a first braze recess, at least part of the first braze recess flanked by the lateral surface on each side of the first braze recess and a base surface different from the lateral surface defining a second braze recess, at least part of the second braze recess flanked by the base surface on each side of the second braze recess; and disposing a braze material between the generally cylindrical cutting element and the at least one surface of the bit body defining the cutting element recess, including within the first braze recess and the second braze recess, the braze material in direct contact with a surface of the first braze recess and a surface of the second braze recess; and rotating the generally cylindrical cutting element relative to the bit body while the generally cylindrical cutting element is disposed in the cutting element recess and while the braze material is disposed between the generally cylindrical cutting element and at least one surface of the cutting element recess, wherein the bit body does not include a surface defining feature on the bit body complementary to the first braze recess in the at least one outer surface of the cutting element.

12. The method of claim 11, further comprising removing material from a lateral surface of the generally cylindrical cutting element to define the first braze recess.

13. The method of claim 12, wherein removing material from the at least one outer surface of the generally cylindrical cutting element comprises using conventional machining techniques.

14. The method of claim 11, further comprising simultaneously forming a generally cylindrical substrate of the generally cylindrical cutting element and the first braze recess in the lateral surface of the generally cylindrical substrate.

15. The method of claim 11, further comprising a second braze recess defined in a base surface of the generally cylindrical cutting element, wherein the base surface is different from the lateral surface.

16. An earth-boring tool, comprising:

a bit body, at least one surface of the bit body defining a cutting element recess in an outer surface of the bit body;

a cutting element secured within the cutting element recess by a braze material at an interface between the bit body and the cutting element, the cutting element including:

a generally cylindrical substrate having a base surface defining a braze recess, at least part of the braze recess flanked by the base surface on each side of the braze recess;

wherein the braze recess is in the form of two grooves extending at least substantially orthogonally in relation to each other; and a polycrystalline diamond compact on the generally cylindrical substrate;

wherein the braze material is disposed between the generally cylindrical substrate of the cutting element and the at least one surface of the bit body defining the cutting element recess, including within the braze recess of the generally cylindrical substrate;

wherein the braze material is in direct contact with a surface of the braze recess; and wherein the bit body does not include a surface defining a feature on the bit body complementary to the braze recess in the generally cylindrical substrate.

* * * * *